US005220637A

United States Patent [19]

Levin, III et al.

[11] Patent Number: 5,220,637

[45] Date of Patent: Jun. 15, 1993

[54] METHOD AND APPARATUS FOR CONTROLLABLY GENERATING SMOKE

[75] Inventors: Charles J. Levin, III, Baltimore; Thomas J. DeSalvo, Ellicott City, both of Md.

[73] Assignee: AAI Corporation, Cockeysville, Md.

[21] Appl. No.: 904,960

[22] Filed: Jun. 26, 1992

[51] Int. Cl.[5] ..... F22B 27/16

[52] U.S. Cl. ..... 392/396; 392/399; 392/405; 392/487

[58] Field of Search ..... 392/396, 394, 399, 402, 392/403, 405, 406, 397, 478, 480, 401, 466, 487

[56] References Cited

U.S. PATENT DOCUMENTS

| | | | |
|---|---|---|---|
| 2,662,332 | 12/1953 | McIntire | 392/399 |
| 2,882,240 | 4/1959 | Charwat | 392/396 |
| 3,247,888 | 4/1966 | Mueller | 392/478 |
| 3,250,723 | 5/1966 | Fortney | 392/399 |
| 3,392,479 | 7/1968 | Simmons | 392/396 |
| 4,349,723 | 9/1982 | Swiatosz | 392/399 |
| 4,568,820 | 2/1986 | Swiatosz | 392/397 |
| 5,078,976 | 1/1992 | Shibauchi | 392/395 |

*Primary Examiner*—Teresa J. Walberg

*Attorney, Agent, or Firm*—Griffin Butler Whisenhunt & Kurtossy

[57] ABSTRACT

An apparatus and method for controllably generating smoke from a simulating smoke-generating fluid. A container holds a supply of simulating smoke-generating fluid. A generally vertically-disposed, hollow, elongated, tubular member having inside walls surmounts the container with a lowermost opening thereof in fluid communication with the container and an uppermost opening thereof capable of being placed in fluid communication with an area into which the smoke is to be introduced. Preferably, gas is moved into the tubular member at a portion thereof near the lowermost end and in a direction generally tangential to a radius of the inside walls such that the gas flows upwardly in a generally spiral-like manner. Smoke generating fluid is moved from the container to a portion of the tubular member near the uppermost end, where the fluid is distributed along the inside walls such that the fluid flows by gravity downwardly toward the container but is also flowed in a generally spiral-like manner by action of the gas passing upwardly in the tubular member. The tubular member is heated such that the inside walls are at temperatures sufficient to vaporize substantial amounts of the fluid, mix the vaporized fluid with gas flowing upwardly in the tubular member and produce the smoke.

35 Claims, 2 Drawing Sheets

METHOD AND APPARATUS FOR CONTROLLABLY GENERATING SMOKE

The present invention relates to methods and apparatus for controllably generating smoke, and especially smoke generated from conventional smoke-generating fluids, such as hydrocarbon or substituted hydrocarbon smoke-generating fluids.

BACKGROUND OF THE INVENTION

Smoke is generated for a number of applications, including military screening of areas, theatrical effects, and training of fire fighters, among others. The present invention relates to these usual applications for smoke generation, but it is particularly useful where the generation of the smoke must be closely controlled. As an example thereof, when smoke is used for training fire fighters, the training environment, e.g. a training chamber, is arranged such that when the trainee properly applies the correct extinguishing agent, at the correct position of a simulated fire and for the correct length of time, the simulated fire is extinguished, and the simulated smoke associated therewith is likewise extinguished. On the other hand, for example, if the trainee does not apply the extinguishing agent for the correct length of time, even though the simulated fire and smoke are discontinued, a "flashback" or "burnback" of sudden reignition is simulated by an immediate burst of simulated fire and smoke. Thus, as opposed to other applications, such as theatrical applications, where the commencement and discontinuance of the smoke in very short periods of time is not necessary, for purposes of training fire fighters, such commencement and discontinuance in a very short period of time is most desirable, in order to realistically represent actual fire conditions for the trainee.

Smoke generation is usually achieved by vaporizing a smoke-generating fluid and mixing that vaporized fluid with air such that an aerosol fog of the vaporized and at least partially condensed smoke-generating fluid is produced. As can be appreciated, therefore, in order to generate smoke from a smoke-generating fluid, the apparatus and methods utilized must heat the smoke-generating fluid to a temperature sufficient to cause substantial vaporization thereof and, at the same time, mix the vaporized smoke fluid with air to provide the aerosol fog of the vaporized and condensed smoke fluid. However, as can also be appreciated, heating the smoke fluid to temperatures sufficient to cause substantial vaporization for smoke-generating purposes and then cooling that fluid to temperatures such that substantial generation of vapor and smoke does not occur, in a very short period of time, poses a considerable difficulty in the art.

Basically, in the prior art, smoke has been produced in one of several manners. First, a hot gas, usually air, is passed in contact with smoke-generating fluid, which may be in either a heated or unheated condition. The hot air causes vaporization of the smoke fluid into the air, and, with cooling, the desired fog results. However, as can be appreciated, if hot air is used to heat the smoke fluid, a considerable time lapse is required for enough hot air to pass in contact with the smoke fluid to cause sufficient heating of the fluid and generation of substantial amounts of vapor therefrom. Therefore, there is a slow and gradual buildup of vaporized smoke fluid in the hot air, and, as a result, there is, correspondingly, a slow and gradual buildup of the fog so produced. This, of course, would be most unsatisfactory for fire fighter trainees, since this would not duplicate actual fire fighting experiences.

Another method is that of heating a pool of smoke fluid to a temperature sufficient that substantial vapors therefrom are produced, and then blowing air, heated or unheated, over the fluid to cause the desired smoke. However, as can be appreciated, in this method, again, during the time period required to sufficiently heat the pool of smoke fluid and the time period required for cooling the pool of smoke fluid, the density of the smoke produced will slowly increase and then slowly decrease, respectively, which, again, is not a realistic representation of actual fire fighting conditions.

Another method in the art is that of atomizing the smoke fluid and forming an aerosol thereof directly in a forced air stream, which may or may not be heated. However, the smoke produced by this method, being relatively cold, has a density greater than air, and rather than the smoke rising, for example in a room, so as to simulate the actual effect of smoke from a fire, the smoke settles toward the floor of that room and gives the appearance of a theatrical effect, rather than a fire effect. This, of course, is totally unacceptable for training fire fighters.

Another method in the art admixes steam with the smoke fluid to produce vapors thereof, and then forces that mixture through narrow orifices into the atmosphere where the steam and vapor are chilled to produce smoke. Here again, the rising effect of smoke in actual fires is not duplicated.

Conventional smoke bombs have also been used for this purpose, but they are not controllable, since once the bomb is exploded, it continues to produce smoke, unabated, until the smoke fluid is depleted.

Representative of the above briefly discussed prior art are U.S. Pat. Nos. 4,439,341; 4,547,656; 4,568,820; 4,764,660; and 4,818,843.

Recently, it has been proposed in the art to provide a vaporizing unit for the smoke fluid where the smoke fluid passes between interior walls and exterior walls of a vaporizing chamber, where the passageway between the walls is narrow such as to produce a very high surface area of walls/volume of fluid ratio. By this means, smoke fluid can be rapidly heated to produce vapors thereof, and then those vapors are expelled into the atmosphere for producing the desired smoke (see U.S. Pat. No. 4,871,115). However, this apparatus has several distinct disadvantages. Firstly, there is a considerable thermal lag in heating and cooling the chamber, with a corresponding lag in the commencement and discontinuance of smoke. Secondly, the narrow passageway between the interior walls and the exterior walls of the vaporizing chamber can be clogged by residues and thermal degradation products of the smoke fluid when heated to vaporization temperatures. This cause unevenness and discontinuities in the vapors produced and, hence, in the smoke produced. Further, the smoke is produced by passing the heated vapors to ambient air, for cooling purposes, and that smoke, of course, as explained above, will be more dense than air and will, therefore, settle. This device is, therefore, very useful for producing theatrical effects, but is not particularly useful for fire fighter training.

A substantial improvement in generating smoke is disclosed in copending application Ser. No. 07/707,868 filed May 31, 1991, commonly assigned, wherein the smoke can be very quickly established or discontinued, and without the problems of the prior art, as recited above, and especially without the problem associated with U.S. Pat. No. 4,871,115, as discussed above. In that copending application, there is disclosed an apparatus for generating smoke from a smoke-generating fluid, wherein a chamber is provided that has a center line between an outlet wall and an inlet wall that is inclined to the horizontal. A particular surface is provided on the lowermost portions of the walls of that chamber, and smoke-generating fluid is flowed from a distribution means at the inlet wall to the outlet wall by gravity. This creates a very thin film of the smoke-generating fluid, and by use of heaters associated with the chamber, that thin film can be very quickly raised to temperatures sufficient to cause substantial vaporization, or quickly lowered to below those temperatures, in order to quickly commence or discontinue generation of the vapor. Vaporized fluid is ejected from the chamber and mixed with heated air. By the combination of the quick generation and discontinuance of vapor and the commencement and discontinuance of ejecting the vapors, smoke can be very quickly started or stopped.

It has been found in practice, however, that this apparatus suffers from some disadvantages in some circumstances. Notably, and particularly in regard to certain smoke-generating fluids, the flow of the fluid in the chamber, as caused by gravity in view of the inclination of the chamber to the horizontal, is not as uniform as would be desired. This is because certain conventional smoke-generating fluids tend to channel on the heated surface of the lowermost portion of the chamber, and the heating and discontinuance of heating of the fluid, with such channeling, is not as quick or efficient as desired.

Further, residues of some smoke-generating fluid tend to collect on the roughened lower vaporization surface because these residues are not flushed from that roughened surface by subsequent flows of that fluid. Thus, somewhat frequent disassembly and cleaning of that device is required.

Further, the size of the device must be relatively large for producing large volumes of dense smoke, and this large size is undesired for some fire-fighting trainer facilities.

It would, therefore, be of substantial advantage in the art to provide an apparatus and method for controllably generating smoke, where that smoke has the same rising characteristics as smoke produced from fires, where that smoke can be quickly commenced and quickly discontinued and where these advantages can be provided with almost any smoke-generating fluid in a highly efficient manner, without channeling or requiring frequent cleaning and in a compact apparatus. It would be a further advantage in the art to provide for such smoke generation by use of relatively modern smoke fluids which have less toxicity and less potential for ignition than older smoke-generating fluids.

BRIEF DESCRIPTION OF THE INVENTION

The present invention is based on four primary discoveries and several subsidiary discoveries. First of all, it was discovered that in order to significantly reduce channeling or like non-uniformity of smoke-generating fluid on a heated surface, it is necessary to cause some mixing, turbulence or other like action of that fluid on that heated surface. Secondly, it was discovered that a given volume of fluid should flow along as great a surface area of the heated surface as practical in order for the fluid to be disposed as a thin film on the heated surface and to create a dynamic heat transfer relationship with the heated surface. Thirdly, it found that, to better control the vaporization of the fluid, to better provide a thin film and to provide a compact unit, the fluid flow along the heated surface should be, at least in part, caused by the flow of the gas used to generate the smoke. Fourthly, it was found that to avoid residues, the flow of the fluid on the heated surface should be such as to flush residues from the heated surface.

As a subsidiary discovery in this regard, it was found that improvements in the smoke generating capabilities of such apparatus could be improved if the heated surface is a generally vertical, elongated, hollow, tubular member with heated inside walls, and the smoke-generating fluid flows generally downwardly, by gravity, along the inside walls of that heating surface.

Secondly, as a subsidiary discovery, it was found that if the gas for producing the smoke is moved along such inside walls, particularly in a counter-current flow direction to the flow of the fluid, much better control over smoke generation could be achieved.

Thirdly, as a subsidiary discovery, it was found that if such gas is introduced into the tubular member in such a manner as to produce a turbulent or spiral-like flow pattern of the gas moving in the tubular member, the interaction of the gas and fluid causes mixing, turbulence, etc. of the fluid. This causes a very thin film of the fluid to be very intimately contacted with the heated surface of the inside walls of the tubular member and considerably reduces channeling of smoke fluids, and, as well, flushes residues from the tubular member.

As a fourth subsidiary discovery, it was found that by controllably adjusting the temperature of such heated inside walls, as well as the gas passing along the inside walls, quick commencement of smoke generation and quick discontinuance of smoke generation could be achieved.

Thus, very briefly stated, the present invention provides an apparatus for controllably generating smoke from a smoke-generating fluid. The apparatus has a container means for containing a supply of smoke-generating fluid. A generally vertically-disposed, hollow, elongated, tubular member having inside walls is in fluid communication with an area into which the smoke is to be introduced.

A gas moving means is provided for moving gas into the tubular member such that the gas flows along the inside walls and eventually into that area for introduction of smoke.

A fluid moving means is provided for moving the fluid from the container means to the tubular member such that the fluid flows downwardly therein (by, at least in part, gravity) along the inside walls.

Tubular member heater means are provided for heating the inside walls of the tubular member such that the inside walls are at temperatures sufficient to substantially vaporize the fluid and to generate a desired amount of smoke.

Similarly, a method is provided for controllably generating smoke, where the above described container and tubular member are provided. A gas and the smoke fluid are moved into the tubular member in the above-described manner, and the inside walls are heated to the above-noted temperatures. The vaporized fluid is mixed with the gas in the tubular member to produce the smoke.

More specifically, in summary of the invention and preferred embodiments, smoke is created by vaporizing a smoke-generating fluid, capturing that vapor in an air stream, and condensing the vapor back to a liquid state while suspended in air in highly-divided droplet form. Vaporization of the fluid causes maximum dispersion of the material in air. Condensation of the fluid in air causes visual obscuration.

The invention uses a heated cylindrical tube, standing generally vertically, as a smoke-generating means. The smoke-generating fluid is distributed along the inside circumference of the tube near its top, permitting the fluid to flow downwardly and coat the inside surface of the tube. A fluid distribution ring is employed to deliver the fluid at a plurality of discrete points along the tube circumference, although a number of different fluid delivery methods are possible. As the fluid flows down the heated tube, heat is transferred to the fluid and the fluid temperature is raised. A preheated air source is injected tangentially into the tube so as to cause a spiral-like vortex air flow pattern within the tube. The air is injected at the bottom of the tube and angled slightly upwardly causing the air to exit from the top of the tube. An alternative, but less desired embodiment, is to have the air injected at the top of the tube (and angled slightly downwardly) causing the air to exit from the bottom of the tube. In either case, the fluid flowing down the walls of the tube is impacted with a spiral-like air flow which causes a number of effects to occur.

The effect of such high speed air, flowing essentially perpendicular to the fluid flow, changes the fluid path direction from essentially vertical to a generally diagonal path, manifesting itself as a spiral-like fluid path along the inside wall of the tube. This lengthens the fluid path over the heated surface of the inside walls and increases the time for heat to transfer to the fluid. This enables the desired fluid temperatures to be reached with use of a short and compact tube. A parallel (non-spiral) air flow may be used, but a much longer tube and more heated surface area would be required to raise the fluid to the same temperatures.

The high speed air flow also impinges on the fluid, causing a flattening and spreading effect of any fluid channelling along the inside walls. This causes a decrease in the fluid film thickness as well as an increase in the contact area between the fluid and the inside walls. Both of these effects increase the amount of heat transferred from the heated tube into the fluid.

Rapid vaporization of the fluid takes place by raising the vapor pressure of the fluid to approximately the pressure of the air in the immediate vicinity of the fluid. In addition, the air pressure immediately over the fluid is reduced by the effect of the high velocity of the air moving over the internal tube surface, as described by Bernoulli's equation. This reduction in air pressure in combination with an increase in fluid temperature results in a rapid vaporization of the smoke-generating fluid.

Additionally, the high air velocity causes a rapid removal of fluid vapor in the immediate vicinity of the fluid. This acts to reduce the saturation of fluid vapor suspended in air and increases the ability of the air to accept more fluid vapor into the air stream.

Once the fluid vapor is captured in the air stream, the vapor cools sufficiently to cause condensation and the formation of liquid particles suspended in air which blocks vision and scatters light.

DETAILED DESCRIPTION OF THE INVENTION

Figure 1:
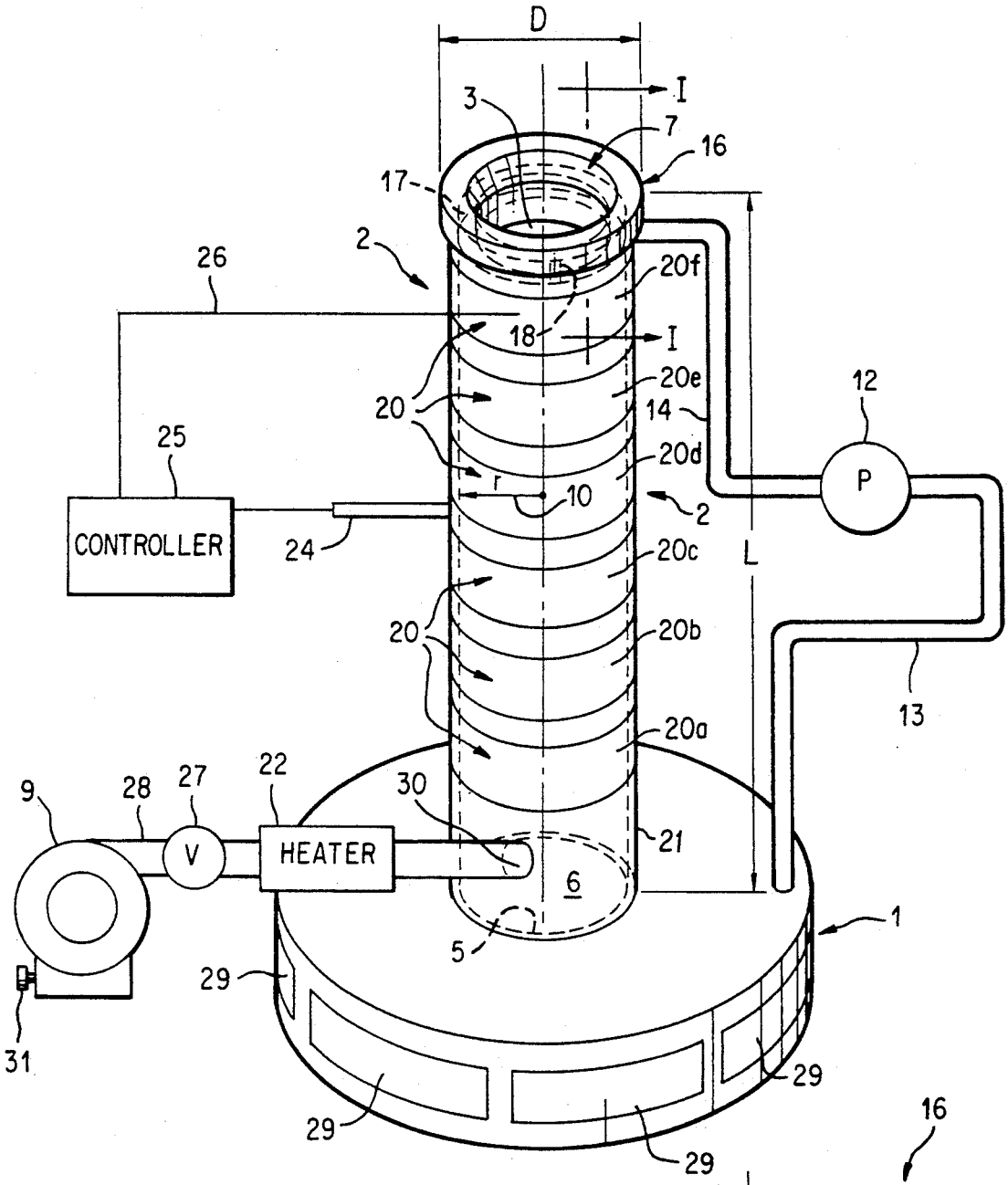
FIG. 1 is a perspective view of an illustrative embodiment of the present apparatus, with portions of that view being shown in diagrammatic form.

As can be seen from FIG. 1, in this illustrative embodiment, a supply container means 1, which is illustrated as a cylindrical container, is provided for containing a supply of the smoke-generating fluid (not shown). Of course, the particular configuration of the supply container means need not be cylindrical and can be in any convenient shape. The container, however, should have a volume sufficient to contain an amount of the fluid to be used for an anticipated amount of smoke to be generated, e.g. from about 5 to 50 liters, although there may be a further supply (not shown) of the fluid flowed to container means 1 to continue the supply of the fluid thereto. However, for the purposes explained below, it is more preferable that the container means have a sufficient volume to contain all of the fluid which would be used for an anticipated generation of smoke.

The tubular member, generally 2, as illustrated in the specific embodiment of FIG. 1, is generally a vertically-disposed, hollow, elongated tubular member. That member 2 has inside walls 3. However, for continued operation, the tubular member has a drain opening 5 such that unvaporized fluid flows from member 2. Of course, it is preferable to collect such drained fluid for reuse, such as in an underneath collection pan, but more preferably, the drain opening is in fluid communication with the container means 1, e.g. through a lowermost portion of the tubular member for direct drainage into container means 1. For this purpose, it is most preferred that tubular member 2 surmounts the container means 1 such that a lowermost drain opening 5 is in fluid communication with the supply of fluid (not shown) in container means 1, i.e. through an opening, generally 6, in the container means 1, for the reasons explained more fully below. An uppermost portion 7 of member 2 is in fluid communication (means not shown, e.g. pipes, hoses, ducts, etc.) with an area into which the smoke produced by the apparatus is to be introduced, e.g. a fire-fighter training room.

A gas moving means 9 is provided for moving a gas, e.g. air, nitrogen, carbon dioxide, most usually air, into the member 2 such that the gas enters the member 2 at a portion of the member 2 near the drain 5, e.g. in lowermost $\frac{1}{3}$ or $\frac{1}{4}$ or $\frac{1}{8}$ of member 2. When the gas is moved into member 2 in a direction generally tangential to a radius 10 of the inside walls 3, the upward flow of gas in member 2 is in a generally spiral-like manner, especially when the gas enters member 2 at a slight elevated angle to the horizontal for the advantages as explained below. However, for those same advantages explained below, the gas may be caused to flow upwardly in member 2 in a turbulent manner. Alternatively, but less desirably, the gas may flow upwardly in member 2 in a laminar manner. Such flows can be caused by a gas flow control means and such control means is illustrated in the Figure by a tangential gas inlet, as explained more fully below, to cause a spiral-like upward flow of the gas. The gas moving means may be, for example, a pump, blower or pressurized gas source, or any other convenient means for moving a gas, particularly air, into member 2.

Fluid moving means 12 moves fluid from the container means 1 to a portion of the member 2, preferably which is near the uppermost portion 7, e.g. in the uppermost ⅓ or ¼ or ⅛ of member 2. This is conveniently accomplished by means of supply lines 13 and 14, cooperating with fluid moving means 12 to achieve a desired flow of the smoke-generating fluid from container means 1 to member 2. For the reasons explained below, preferably, the fluid moving means is controllably adjustable so as to move selected amounts of fluid from the container means 1 to a fluid distribution means, generally, 16, which fluid distribution means is explained in more detail below, and that fluid moving means, for example, may be a variable delivery pump or a variable pressure head, among others.

Figure 2:
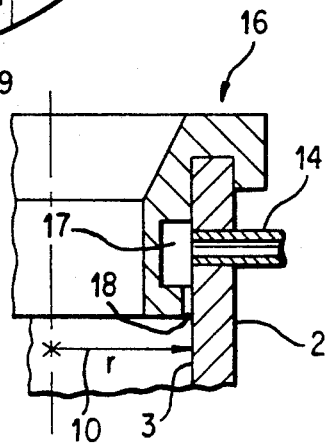
FIG. 2 is an enlargement of a portion of FIG. 1 along section lines I—I.

In this latter regard, the fluid distribution means, generally, 16 is provided for distributing the fluid, generally, along the inside walls 3 of member 2 such that the fluid is flowable by gravity downwardly toward the lowermost portion of member 2, e.g. to container means 1. Also, for example, when the gas flow, particularly, is in a spiral-like manner or a turbulent manner, the fluid also flows downwardly along inside walls 3 in a, generally, spiral-like manner or turbulent manner by action of the gas passing upwardly in member 2, as explained more fully below. While the fluid distribution means may take a variety of forms, conveniently, the distribution means includes an annular groove 17 on walls 3 (see also FIG. 2), and preferably that groove is substantially tangential to radius 10 and along an entire circumference of the inside walls, as shown in FIG. 1. Such a groove will distribute the smoke-generating fluid along the entire circumference of inside walls 3 such that fluid may be relatively uniformly flowed onto the entire circumference of inside walls 3. For this latter purpose, the groove may have slots 18 for allowing the fluid to flow from the annular groove and into and along the circumference of inside walls 3, although any other such means, such as a porous material in the groove or slots, or the like, may be used or the fluid may be allowed to overflow an upper opening (not shown) in groove 17 and spill therefrom. Alternatively, the fluid distribution means may be a spray nozzle (not shown) directed downwardly to spray droplets of fluid onto the walls of member 2, e.g. a hollow cone-patterned spray nozzle, or the fluid distribution means may be a revolving arm (not shown) with fluid outlets to spray droplets of fluid onto walls 3, with the revolution thereof caused by the jet action of the exiting fluid. The particular fluid distribution means is not critical, and it is only important that the fluid be relatively uniformly distributed along the entire circumference of the inside walls 3.

Tubular member heater means 20, for heating member 2, are provided such that the inside walls 3 of member 2 may be heated to temperatures, in combination with the moving gas stream, sufficient to vaporize a desire amount of the smoke-generating fluid, which causes mixing of the vaporized fluid with gas flowing upwardly in member 2, and produce a smoke thereof. While these heater means may take a variety of forms, conveniently, the heater means are on the outside walls 21 of member 2, and the heater means are adjustable in heat output. For example, the heater means 20 may be a series of spaced-apart heaters 20*a* through 20*f*, e.g. 3 to 12 such heaters (six being shown), so that a temperature profile along the length of the member 2 is establishable, for the reasons explained more fully below.

Preferably, the gas moving means 9 has associated therewith a gas heater means 22 which is capable of heating the gas passing therethrough to a temperatures sufficient for vaporizing a desired amount of the smoke-generating fluid. For example, the gas moving means 9 may be a turbine blower, fan blower, or the like, and incorporated with that means may be electrical heating coils (not shown) for heating a gas, e.g. air, passing through the heater means 9, and in this case, a separate heater means 22 will not be used. On the other hand, when the gas moving means 9 flows gas therefrom, a separate gas heater means 22 for heating the gas may be used.

A thermocouple 24, or any other desired temperature measuring device, measures the temperature of the member 2, and more preferably the temperature of the inside walls 3 thereof. That thermocouple or other like device is operably connected to a controller 25 which adjusts the heat delivered by heater means 20*a* through 20*f* to provide a desired temperature profile of the inside walls 3, for the reasons explained more fully below. For example, controller 25 may turn on and off electric power passing through electrical current lines to the heaters 20*a* through 20*f* (one such line 26 being shown) or the amount of power may be controlled by conventional means.

A one-way valve 27, e.g. a conventional check valve, is placed in gas line 28 to ensure that the heated gas and/or smoke generated by the apparatus does not flow back into the gas moving means 9.

A plurality of container means heaters 29, e.g. 1 to 12 thereof, may be disposed on container 1 to heat the fluid in the container, for the reasons explained below. These container means heaters are sufficient o heat the fluid in the container to temperatures sufficient for effecting vaporization of the fluid.

While member 2, as explained above, is generally a vertical (upright), hollow, elongated, tubular member, the particular configuration thereof is not narrowly critical. The configuration could be rectangular, or hexagonal, or square, or the like, but these shapes, as would be apparent, tend to cause some channeling of the fluid, even with spiral-like or turbulent flow of the gas and, accordingly, are not normally used. However, the configuration could be very usefully elliptical, although this is less preferred, but in any case, the inside walls 3 should not have a configuration which promotes substantial channeling of the particular smoke-generating fluid being used, since this would result in the disadvantages of the prior art, as described above. Thus, the meaning of generally vertical, hollow, elongated tubular member, as used in the specification and claims, is with the foregoing as part of that meaning. However, most preferably, the inside walls of the tubular member are cylindrical.

The relative dimensions of the member 2, in substantially cylindrical form, are not narrowly critical, but should be such as to ensure that the smoke-generating fluid will flow over a substantial surface area of the inside walls, as it passes down member 2. To ensure this, preferably, the ratio of the length L to the diameter D thereof should be from about 3:1 to 20:1, and more preferably from about 5:1 to 15:1, and more usually somewhere about 8:1. The diameter of the inside walls 3 should be from about 2 cm to 60 cm, and more preferably about 5 cm to 20 cm. The length L should be at least about 10 cm and up to about 3 or 4 meters.

It is important that the fluid flow by gravity down inside walls 3 and in a well-dispersed manner, i.e. in a thin film, substantially covering the inside walls to the extent practical, with as little channeling as practical. This is better provided when the tubular member is vertical, i.e. upright, but it is not necessary that the tubular member be exactly vertical. Satisfactory results are achieved when the tubular member is only slightly inclined to the vertical, e.g. an inclination of about 10° or less. Greater inclinations will begin to adversely effect the uniformity of the film, and at inclinations of about 20°, the uniformity of the film is unsatisfactory, i.e. substantial channeling occurs. Thus, in the present specification and claims, the term generally vertical is intended to mean that the tubular member is inclined to the vertical by no more than 20°, more usually no more than 10°, and most preferably substantially vertical.

The reasons for the above elements of the present apparatus will be apparent from the following explanation of the operation thereof and the method practiced therewith. It will be appreciated from the following explanation that a major point of the invention is that of providing a very thin film of the smoke-generating fluid as it flows down the member 2. That thin film is in intimate contact with a gas, e.g. air, passing through member 2, so as to quickly commence or discontinue generation of smoke, and to cause the generated smoke to be lighter than air so that it will rise in a training area, for the reasons explained above.

Thus, smoke-generating fluid (not shown in the Figure) is moved from container means 1 via line 13 to the fluid moving means 12, e.g. a pump, and supply line 14 to groove 17, where it flows along the entire circumference of the inside walls 3 and spills over at a plurality of spaced-apart slots 18 onto the inside walls 3 and flows, by gravity, downwardly thereon toward lowermost drain 5. Any unvaporized fluid returns in a heated condition to container 1 via opening 6. Therefore, there is a continuous circulation of the heated fluid when the apparatus is in operation, and that fluid flows substantially uniformly and continuously down the inside walls 3 which, in addition, flushes residues from member 2. At the same time, gas is introduced into the member 2 at an inlet 30 by gas moving means 9 which, preferably, is adjustable such that the flow of gas therethrough is adjustable in volume. For example, when gas moving means 9 is a conventional electric-operated blower, the speed of the blower, and hence the volume of the gas delivered, can be controlled by conventional rheostat 31, although other adjustable flow means may be used, e.g. valves and orifices. The gas passes through inlet 30 into member 2. When that gas is introduced into member 2 in a direction generally tangential to radius 10 of the inside walls 3, as illustrated in FIG. 1, the gas will flow upwardly along those inside walls in a generally spiral-like manner. That spiral-like upward flow of gas will encounter the thin film of fluid flowing, by gravity, down inside walls 3, and when that fluid is in a thin film, e.g. from about 0.1 to 5 mm in thickness, that thin film, under the pressure and force of the gas, will also flow in a somewhat counter-current spiral-like manner down the inside walls 3, e.g. in a pattern somewhat like the pattern of stripes on a barber pole. This causes the fluid to remain well-dispersed (avoids channeling) and uniformly disposed on those inside walls, so that excellent heat conductivity between the walls and the film may be achieved. Further, since the spiral-like flow of the fluid increases the contact time between the thin film and the inside walls, and hence provides substantial contact surface area, rapid heat transfer from the inside walls to the fluid will be achieved. In effect, this pattern increases the distance the film travels on the inside walls from the distribution means 16 to the drain 5. Further, the counter-current, spiral flow of gas flattens that pattern to cause the film to spread out and more nearly completely wet the inside walls. Any fluid not vaporized during its passage through tubular member 2 will, of course, drain, in a heated condition, into container 1 through opening 6.

The gas flow can be in a laminar manner through member 2 by introducing the gas thereinto by an inlet disposed at the bottom of member 2 (not shown), but such laminar flow of gas does not provide the above-described well-dispersed film of fluid and is not preferred. However, a reasonably acceptable dispersed film of fluid can be provided by a turbulent flow of gas through member 2. This can be achieved, for example, by introducing the gas into member 2 through an elbow, or the like (not shown), to cause such turbulent introduction of the gas.

Nevertheless, it is greatly preferred that the gas flow pattern be in the spiral-like manner, since this provides far better results. It is, also, most preferred to accentuate this pattern by declining the center line of inlet 30 to the horizontal, e.g. by up to 20°, e.g. 10° or 5°, such that the initial introduction of the gas into tubular member 2 is in a slightly upward direction. Alternatively, a conventional gas deflector or "scoop" may be placed in inlet 30 to cause that same slightly upward flow of gas as it initially enters member 2.

The contact heater means 20 heats member 2 to temperatures sufficient to vaporize a desired amount of the smoke-generating fluid. Depending upon the temperature of the gas entering inlet 30, a temperature profile along the inside walls 3 may be established. The temperature of the gas entering inlet 30 and the temperature of the inside walls 3, between the two, establish sufficient heat in the thin film of the fluid flowing down the inside walls to achieve rapid vaporization, or rapid cessation of that vaporization. For example, the temperature of the fluid will be heated as it flows down the inside walls, and if that temperature is at higher levels, and if the temperature of the entering gas is at higher levels, then the entering gas will have sufficient heat so as to vaporize substantial amounts of fluid almost immediately on contact therewith. On the other hand, if the temperature of the entering air is lower, then insufficient heat will be supplied to the fluid to cause such immediate vaporization of substantial amounts of fluid, and the amount of vaporization and, hence, amount of smoke generation will immediately be decreased. Thus, by controlling the temperatures of the gas by means of gas heater 22 and the temperatures of the fluid by means of heaters 20, a balance between the two can be achieved which will allow for such quick commencement and cessation of smoke generation and control the amount and density of the smoke.

To make this balance even more fine, container 1 may be heated by a plurality of container heaters 29, controlled by a thermostat (not shown), so as to ensure that the fluid being moved to member 2 is at desired temperatures. If these temperatures are maintained, and the temperature of the entering gas is likewise maintained, then the amount of smoke generated can be controlled, to some extent, by the volume of gas moved by gas moving means 9. With this arrangement, decreases of smoke generation can easily be achieved simply by slowing down or turning off gas moving means 9.

On the other hand, for certain types of smoke generation, other relative temperatures along the lines of those discussed may be used. For example, the temperature of the fluid, via heaters 20 and heaters 29, may be maintained such that a small amount of fluid is vaporized. By controlling gas moving means 9, the volume and density of smoke generated may be controlled.

Also, for certain applications, it can be most useful for the temperature along the inside walls 3 to be less than substantially uniform, and, indeed, have a temperature profile therealong. By using a plurality of spaced-apart heaters 20*a* through 20*f*, which can be controlled by a plurality of thermocouples 24 (only one being shown in FIG. 1), and a combination controller 25 or plurality of controllers 25, the temperature of inside walls 3 may be varied as desired. For example, the temperature may be varied such that there is a higher temperature of the walls and, hence, the fluid at heater 20*a* or 20*b* or even 20*c*, than at the remainder of the heaters. This can be used to effectively shorten length L of member 2 and effect some changes in the generated smoke.

The heater means 20, 22 and 29, described above, may be any type of heater means desired, such as enveloping heaters with superheated steam, propane heaters, or the like, but more usually the heaters will be simple electrical resistance heaters controlled by thermostats and rheostats, as described above. Whatever type of heater is involved in the various heaters, the more critical heating is the temperature to which the thin film of fluid is subjected. This temperature will depend upon the particular smoke fluid being utilized. However, modern smoke fluids require a temperature of at least about 400° F. and up to about 1000° F. in order to vaporize substantial amounts of fluid. In order that the apparatus may handle any of the modern smoke fluids, the heaters and controllers should be capable of heating and controlling the member 2 and/or air flow from gas heater 22 and/or heaters 29 to at least within that temperature range.

In this latter regard, it will be appreciated that the usual smoke generating fluids are not single chemical compounds, and, hence, do not have a narrow boiling point. It will likewise be appreciated that the amount of fluid vaporized from the thin film depends on the temperature of that film, the temperature of the gas and the flow of the gas. For example, at a fluid temperature of 500° C., for a particular fluid, a particular gas temperature and flow, the rate of vaporization of the fluid may be twice the rate of that fluid at a temperature of 300° C. and one-half the rate of that fluid at a fluid temperature of 700° C. Thus, the temperature of the fluid is chosen, in part, depending on the rate and, hence, amount of vaporization (and smoke generation) desired.

As noted above, the gas heater 22 may be as desired, and that heater may, in fact, be incorporated into the gas moving means, e.g. blower, 9. Here again, that heater could be an electrical heater, steam heater or infrared heater, but most conveniently the gas moving means is a conventional blower with electrical-resistant heaters and the speed of the blower and the power to the electric heaters are controlled via conventional controllers to provide the temperature of the gas, e.g. air, as desired and as noted above.

Also, heaters may be placed above the fluid distribution means 16 so as to heat generate smoke in upper portions of member 2 to effect the character of the smoke.

Figure 3:
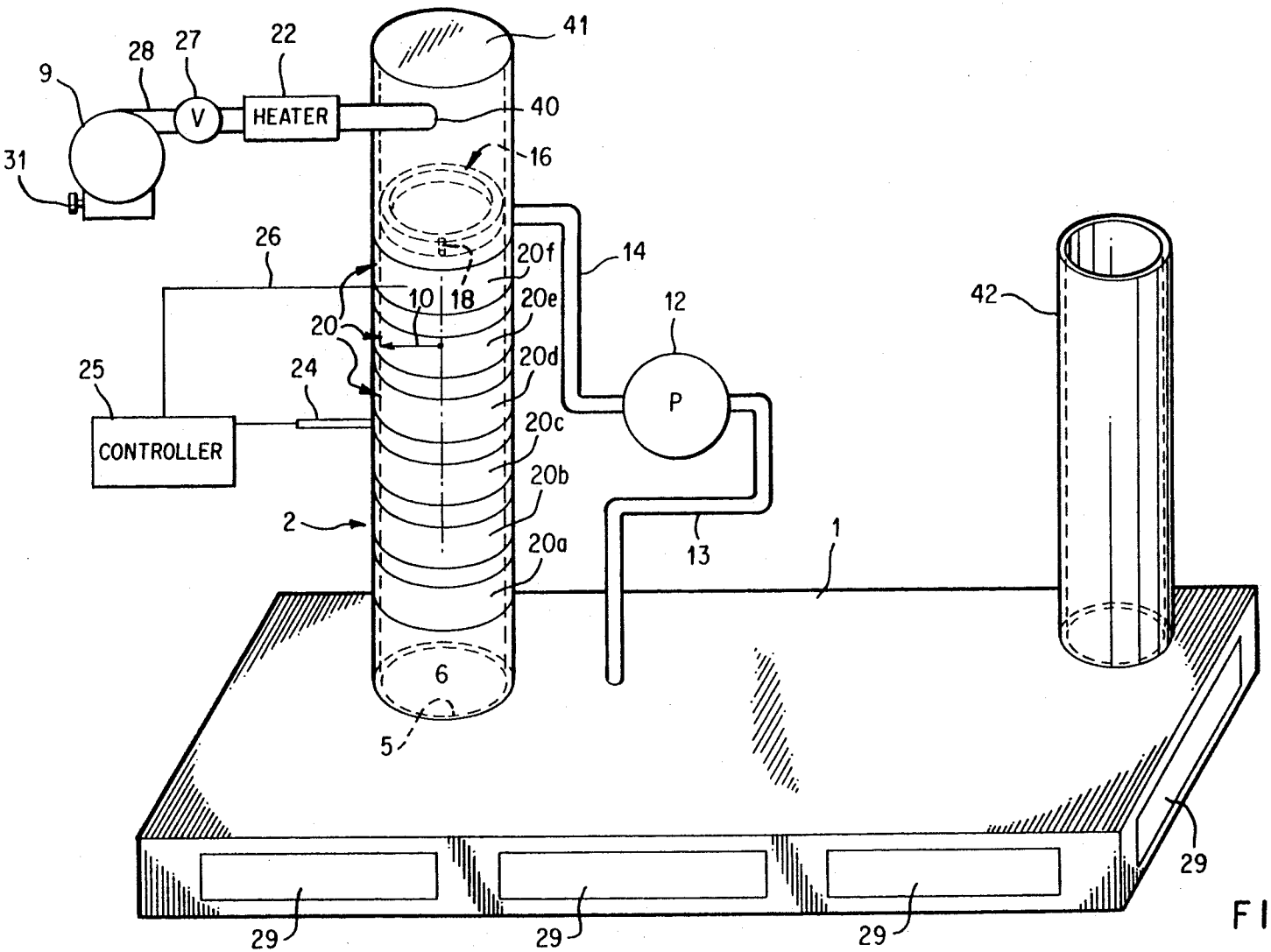
FIG. 3 is a perspective view of a further illustrative embodiment of the present apparatus, with portions of that view being shown in diagrammatic form.

The above describes a preferred embodiment of the invention. FIG. 3 shows an alternate, but less preferred, embodiment. In that Figure, like elements are designated by the same numerals as that of FIGS. 1 and 2. In this embodiment, the gas is introduced into tubular member 2 in a co-current direction with that of the downward flow of smoke-generating fluid. Thus, the gas moving means 9 is positioned such as to move gas through a top inlet 40 in a closed cap 41 which surmounts tubular member 2 and the gas moves toward opening 6 and into container means 1, which in the embodiment of FIG. 3 is shown in rectangular configuration. The gas passes through container means 1 (above the level of the smoke fluid therein) and out of container means 1 through discharge 42, which in that Figure is shown as a pipe. Discharge 42 is, of course, in fluid communication with the area into which the smoke is to be introduced, e.g. a fire-fighter trainer, by means not shown, e.g. hoses, tubes, pipes, ducts, etc. Otherwise, the arrangement and operation of the apparatus of FIG. 3 is the same as that described above in connection with FIGS. 1 and 2.

It will easily be appreciated that the arrangement of FIG. 3 will cause the smoke fluid to be somewhat pushed by the gas toward opening 6, and for this reason, the residence time and time of contact on inside walls 3 of the smoke fluid will be decreased. Accordingly, all other things being equal, the length L of tubular member 2 in this embodiment should be longer, e.g. 10% to 30% longer, than the corresponding embodiment of FIG. 1. Further, in the embodiment of FIG. 3, laminar flow is even less desired, and even turbulent flow is less desired, than the above-described spiral-like flow of the gas. In the embodiment of FIG. 3, the spiral-like flow of gas considerably improves the reduction in channeling and improves the spreading of the thin film of smoke fluid on inside walls 3.

Nevertheless, for some applications, the arrangement of FIG. 3 may be of advantage. For example, when a very viscose smoke fluid is used, the introduction of the gas near distribution means 16 can effect a more uniform initial distribution of the smoke fluid on inside walls 3. Also, the sweep of gas above the level of the smoke fluid in container means 1 will utilize smoke fluid vapor in container means 1 and the passage of the gas through container means 1 will tend to displace from the gas stream any unvaporized droplets of smoke fluid which may be entrained in the gas.

Any of the conventional smoke fluids may be used with the present apparatus, including modern butylated triaryl phosphate esters. These more modern smoke fluids have considerable advantages over older smoke fluids, such as propylene glycol, military fog oil, diesel fuel, JP8 and P&G 200, since the vapors, and hence the smoke produced therefrom, are considerably less toxic than the older fluids and have a considerably less tendency to ignite. However, butylated triaryl phosphate esters do require quite high temperatures for adequate vaporization. With older conventional apparatus for generating smoke, these higher temperature result in a considerable lag between the time heating commences for generating smoke and actual smoke generation.

Thus, particularly, with the modern smoke fluids, the older apparatus are not capable of achieving quick commencement and quick discontinuance of the smoke being generated, and during start-up and shut-down, the smoke densities vary considerably, so that even both rising and falling smoke results, a very undesired situation. With the present apparatus, smoke can be quickly commenced or quickly discontinued, even with the modern butylated triaryl phosphate esters and controlled densities are maintained. Nevertheless, any of the older more conventional smoke fluids may be used with the present apparatus and method.

While the invention has been explained above in connection with, primarily, the apparatus illustrated by FIGS. 1 and 3, it will be easily appreciated from the above explanation that the particular embodiments of FIGS. 1 and 3 are not critical to the apparatus or process. As explained above, to achieve the rapid vaporization of the smoke fluid, it is necessary for the smoke fluid to be presented as a thin film for vaporization purposes and for successful operation of the apparatus and method, that thin film should flow by gravity. When the thin film is flowed by mechanical means or pressure means, channeling of the thin film is likely to occur, and instead of a thin relatively uniform film, rivulets of film may occur, with considerable decrease in surface area of the film and slow vaporization of the smoke fluid.

It will also be appreciated that other important features of the present invention are the substantially vertical disposition of member 2, as explained above, and its tubular configuration. This allows flushing of residues therefrom, allows the advantageous spiral-like gas flow and provides an efficient operation of the device, and without the undesired channeling of the fluid.

Finally, as can be appreciated from the above, the present invention allows such control of the smoke generating fluid and gas, and the temperatures thereof, that almost any desired simulated smoke can be easily and quickly generated or discontinued. This allows the generated smoke to simulate almost any type of fire and, hence, presents very realistic conditions for fire-fighting training.

Having described the invention, it will be quite apparent to those skilled in the art, that many modifications of the above detailed description will be apparent, and it is intended that those modifications be embraced by the spirit and scope of the annexed claims.

What is claimed is:

1. An apparatus for controllably generating smoke from a smoke-generating fluid comprising:

(a) container means for containing a supply of smoke-generating fluid;

(b) a generally vertically-disposed, hollow, elongated, tubular member having inside walls and capable of being placed in fluid communication with an area into which the smoke is to be introduced;

(c) gas moving means for moving a gas into the tubular member such that the gas flows along the inside walls in a spiral-like manner or in a turbulent manner;

(d) fluid moving means for moving the fluid from the container means to the tubular member such that the fluid flows downwardly therein along the inside walls; and (e) tubular member heater means for heating the inside walls of the tubular member such that the inside walls are at temperatures sufficient to vaporize substantial amounts of the fluid and generate smoke thereof.

2. The apparatus of claim 1 wherein the tubular member has a drain opening therein such that unvaporized fluid flows from the tubular member.

3. The apparatus of claim 2 wherein the drain opening is in fluid communication with the container means.

4. The apparatus of claim 3 wherein the drain opening is in a lowermost portion of the tubular member and the tubular member surmounts the container means.

5. The apparatus of claim 1 wherein the gas flows upwardly in the tubular member.

6. The apparatus of claim 1 wherein the gas enters the tubular member in a direction generally tangential to the radius thereof and the gas flow is upwardly in a spiral-like manner.

7. The apparatus of claim 1 wherein the gas enters the tubular member and flows in the tubular member in a turbulent manner.

8. The apparatus of claim 1 wherein the fluid moving means flows fluid to a fluid distribution means for distributing the fluid generally along the inside walls of the tubular member.

9. The apparatus of claim 8 wherein at least some of the tubular member heater means are disposed above the fluid distribution means.

10. The apparatus of claim 1 wherein the container means has heater means associated therewith capable of heating the fluid to temperatures sufficient to cause vaporization thereof.

11. The apparatus of claim 1 wherein the tubular member is substantially cylindrical and the ratio of length to the diameter thereof is from about 3:1 to 20:1.

12. The apparatus of claim 1 wherein the gas moving means is one of a pump, blower or pressurized gas source.

13. The apparatus of claim 1 wherein the gas moving means has associated therewith gas heater means capable of heating the gas passing therethrough to a temperatures sufficient to cause vaporization of the fluid.

14. The apparatus of claim 1 wherein the gas moving means flows gas therefrom to a gas heater means capable of heating the gas to temperatures sufficient to cause vaporization of the fluid.

15. The apparatus of claim 1 wherein the fluid moving means is controllably adjustable so as to move selected amounts of the fluid from the container means to the tubular member.

16. The apparatus of claim 15 wherein the fluid moving means is a variable delivery pump.

17. The apparatus of claim 8 wherein the fluid distribution means include an annular groove at the inside walls.

18. The apparatus of claim 17 wherein the groove is along an entire circumference of the inside walls.

19. The apparatus of claim 1 wherein the tubular member heater means are disposed on outside walls of the tubular member.

20. The apparatus of claim 19 wherein the heater means are adjustable in the heat output.

21. The apparatus of claim 20 wherein the tubular member heater means is a series of spaced-apart heaters so that a temperature profile along a length of the tubular member is establishable.

22. The apparatus of claim 1 wherein the gas moving means is adjustable such that the flow of gas through the tubular member is adjustable in volume.

23. A method for controllably generating smoke from a smoke-generating fluid, comprising:

(a) providing a container for containing a supply of smoke-generating fluid;

(b) providing a generally vertically-disposed, hollow, elongated, tubular member having inside walls and capable of being placed in fluid communication with an area into which the smoke is to be introduced;

(c) moving a gas into the tubular member such that the gas flows along the inside walls in a spiral-like manner or in a turbulent manner;

(d) moving the fluid from the container to the tubular member such that the fluid flows downwardly along the inside walls;

(e) heating the inside walls of the tubular member to temperatures sufficient to vaporize substantial amounts of the fluid; and (f) mixing the vaporized fluid with flowing gas in the tubular member to generate smoke thereof.

24. The method of claim 23 wherein the container is heated sufficiently to vaporize fluid.

25. The method of claim 23 wherein the tubular member is substantially cylindrical and the ratio of length to the diameter thereof is from about 3:1 to 20:1.

26. The method of claim 23 wherein the gas moved into the tubular member is preheated to a temperatures sufficient to vaporize the fluid.

27. The method of claim 23 wherein the fluid is moved to the tubular member in a controllably adjustable manner so that selected amounts of the fluid are moved from the container to the tubular member.

28. The method of claim 23 wherein the gas flows upwardly in the tubular member manner or in a turbulent manner.

29. The method of claim 23 wherein the gas is flowed into the tubular member in a direction generally tangential to a radius thereof and the gas flow is upwardly in a spiral-like manner.

30. The method of claim 23 wherein the fluid is distributed along the inside walls of the tubular member by flowing the fluid through an annular groove at the inside walls.

31. The method of claim 30 wherein the groove has slots therein for allowing the fluid to flow from the groove.

32. The method of claim 23 wherein the outside walls of the tubular member are heated.

33. The method of claim 32 wherein the outside walls are adjustably heated.

34. The method of claim 33 wherein the heating is by a series of spaced-apart heaters so that a temperature profile along the length of the tubular member is establishable.

35. The method of claim 23 wherein the gas is adjustably moved to the tubular member such that the flow of gas therethrough is adjustable in volume.

* * * * *